US009200376B2

(12) United States Patent
Keller et al.

(10) Patent No.: US 9,200,376 B2
(45) Date of Patent: Dec. 1, 2015

(54) DEVICE AND METHOD FOR SIMULTANEOUS COATING OR DE-COATING OF A PLURALITY OF WORKPIECES AND WORKPIECE

(75) Inventors: Rolf Keller, Rutesheim (DE); Michael Lingner, Vaihingen/Enz (DE); Harald Bauer, Sindelfingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 893 days.

(21) Appl. No.: 13/259,671

(22) PCT Filed: May 11, 2010

(86) PCT No.: PCT/EP2010/056486

§ 371 (c)(1),
(2), (4) Date: Dec. 7, 2011

(87) PCT Pub. No.: WO2010/130750

PCT Pub. Date: Nov. 18, 2010

(65) Prior Publication Data

US 2012/0175260 A1 Jul. 12, 2012

(30) Foreign Application Priority Data

May 13, 2009 (DE) ..... 10 2009 003 072

(51) Int. Cl.

| | |
|---|---|
| ***C25D 5/08*** | (2006.01) |
| ***C25D 5/02*** | (2006.01) |
| ***C25D 17/06*** | (2006.01) |
| ***C25D 17/12*** | (2006.01) |
| ***C25D 17/18*** | (2006.01) |

(Continued)

(52) U.S. Cl.
CPC *C25D 5/022* (2013.01); *C25D 5/08* (2013.01); *C25D 17/06* (2013.01); *C25D 17/12* (2013.01); *C25D 17/18* (2013.01); *C25F 5/00* (2013.01); *C25F 7/00* (2013.01)

(58) Field of Classification Search
CPC ..... C25D 5/08; C25D 17/06–17/08; C25D 5/02–5/028
USPC ..... 205/131–132
See application file for complete search history.

(56) References Cited

U.S. PATENT DOCUMENTS

2004/0094427 A1 5/2004 Economikos et al.

FOREIGN PATENT DOCUMENTS

| | | |
|---|---|---|
| CN | 2302269 | 12/1998 |
| CN | 1316023 | 10/2001 |

(Continued)

OTHER PUBLICATIONS

Takayama, abstract and machine translation, JP 2006-022360 (2006).*

*Primary Examiner* — James Lin
*Assistant Examiner* — Ho-Sung Chung
(74) *Attorney, Agent, or Firm* — Kenyon & Kenyon LLP

(57) ABSTRACT

A device for simultaneous coating of a plurality of workpieces is described, the plurality of workpieces being situated in a shared flow shaft through which an electrolyte flows, and each workpiece being connected electrically conducting to at least one component electrode and being electrically insulated in relation to at least one bath electrode, and a plurality of flow channels and a flow distributor for distributing the electrolyte stream to the plurality of flow channels further being situated in the flow shaft, the at least one bath electrode being situated in one of the flow channels.

9 Claims, 4 Drawing Sheets

(51) Int. Cl.
*C25F 5/00* (2006.01)
*C25F 7/00* (2006.01)

(56) References Cited

FOREIGN PATENT DOCUMENTS

| | | | | |
|---|---|---|---|---|
| DE | 197 35 244 | | 2/1999 | |
| JP | 62-297489 | | 12/1987 | |
| JP | 8-209384 | | 8/1996 | |
| JP | 2006-022360 | * | 1/2006 | ..... C25D 17/08 |
| JP | 2006-506523 | | 2/2006 | |
| JP | 2007-239045 | | 9/2007 | |
| JP | 2008-303463 | | 12/2008 | |
| JP | 2009-517543 | | 4/2009 | |
| JP | 2010-502830 | | 1/2010 | |
| WO | WO 2005/123989 | | 12/2005 | |

* cited by examiner

DEVICE AND METHOD FOR SIMULTANEOUS COATING OR DE-COATING OF A PLURALITY OF WORKPIECES AND WORKPIECE

FIELD OF THE INVENTION

The present invention is directed to a device for simultaneous coating or de-coating of a plurality of workpieces and workpiece.

BACKGROUND INFORMATION

Such devices may be generally available. For example, a device for chromium plating of surfaces of workpieces to be chromium-plated is discussed in DE 197 35 244 B4, the workpieces being connected electrically conducting on the cathode side to a cathode and surfaces of the workpieces to be chromium-plated being situated opposite to a planar anode, and an electrolyte being supplied to the workpieces in a shared supply flow chamber for the chromium plating of the surfaces to be chromium-plated. The workpieces are guided through a screen on the anode side, so that the surface areas of the workpieces adjoining the surfaces to be chromium-plated are covered by the screen and the electrolyte is only applied to the surfaces to be chromium-plated. Individual regulation of the electrolyte stream or adjustment for each individual workpiece is not provided.

SUMMARY OF THE INVENTION

The device according to the present invention for simultaneous coating or de-coating of a plurality of workpieces and the method according to the present invention for simultaneous coating or de-coating of a plurality of workpieces according to the other independent claims have the advantage over the related art that, with the aid of the bath electrode situated in the flow channel, the electrolyte stream in the direction of the at least one workpiece is modifiable separately and independently of the electrolyte flows in the direction of the other workpieces, i.e., in other flow channels. This has the advantage that, on the one hand, the electrolyte stream to the one workpiece is adaptable in a targeted way and, on the other hand, the impacts of the one workpiece, for example, a poor contact of the workpiece with the component electrode or a disadvantageous surface condition of the workpiece, may be compensated for and do not additionally affect adjacent workpieces. For example, a poor contact of this one workpiece with the component electrode is thus prevented from causing an undesirable increased electrolyte accumulation on adjacent workpieces. The rejection of workpieces is therefore significantly reduced and the quality and precision of the coating is substantially increased overall in relation to the related art. In particular, the layer thickness for each workpiece may be regulated separately, in particular via the connection of the individual workpieces to separate current sources (for example, one current source for each workpiece).

In addition, in spite of the impact of the electrolyte stream in the direction of the at least one workpiece, a plurality of workpieces is coated simultaneously, so that a comparatively high throughput or a high output of the device is ensured. The entire electrolyte stream is particularly advantageously distributed uniformly in particular to the plurality of flow channels with the aid of the flow distributor, so that an appropriate partial electrolyte stream which is guided into the corresponding flow channel is assigned to each individual workpiece and/or to multiple workpieces. In order to design the electric field formed between the component electrode and the bath electrode to be substantially equally distributed over the entire cross section of the flow shaft of the device or over the entire plurality of workpieces, a minimum distance is required between the bath electrode and the plurality of workpieces. A parabola flow profile disadvantageously forms in the event of a greater distance between the component electrode and the bath electrode in the flow shaft, which is necessary for the electric field lines, so that the fluidic boundary conditions for coating or de-coating are not identical over the entire cross section of the flow shaft and are therefore not identical for all workpieces of the plurality of workpieces. By situating a plurality of flow channels between the plurality of workpieces and the particular bath electrodes, the formation of a parabola flow profile is advantageously suppressed even in the case of comparatively large distances between the plurality of workpieces and the bath electrodes. A significantly more uniform coating of all workpieces is thus advantageously achieved. The device may include a matrix-type arrangement of the plurality of workpieces, the electrolyte, as it comes from the bath electrode, particularly may flow through the flow shaft in the direction of the plurality of workpieces, and the matrix being oriented perpendicularly to the flow direction of the electrolyte through the flow shaft.

The plurality of bath electrodes, component electrodes, additional electrodes, and/or flow channels may be situated adjacent perpendicularly to the flow direction and particularly may include a matrix arrangement having the same raster dimensions of the matrix arrangement of the plurality of workpieces. The device functions in particular for chromium plating of workpieces. For coating, the bath electrode may include an anode and the component electrode may include a cathode, while for de-coating, the bath electrode may include the cathode and the component electrode may include the anode. In a specific embodiment, the device has a further bath electrode, which is situated upstream from the flow distributor in the flow shaft against the flow direction of the electrolyte, and which particularly may include a planar electrode, which is provided as a shared anode or cathode for a plurality of workpieces. The device further includes in particular a screen known from the related art, whereby partial coating of individual surface areas of the particular workpieces is made possible. In particular, it is provided that precisely one single workpiece is situated in each flow channel. These screens are provided separately for each workpiece, in groups of workpieces, and/or for the entirety of the workpieces.

Advantageous embodiments and refinements of the present invention may be inferred from the description, with reference to the drawings.

According to a refinement, it is provided that a single component electrode and/or bath electrode is/are assigned to multiple workpieces. In particular, all workpieces are thus advantageously held at a shared electric potential, so that the interconnection complexity is comparatively low.

According to a further refinement, it is provided that at least one additional electrode, which may include a virtual electrode and particularly may include a throttle, is situated between the at least one component electrode and the at least one bath electrode. The electric field between the workpiece and the bath electrode is advantageously impacted by the virtual electrode, so that the electric field is guided in particular directed onto the workpiece. For this purpose, the virtual electrode in particular includes a throttle constriction, which is situated in the flow channel between the workpiece and the bath electrode and is provided for bundling the electric field.

According to a further refinement, it is provided that one component electrode, one bath electrode, and/or one additional electrode are each assigned to precisely one workpiece. Precisely one bath electrode may be assigned to each workpiece, so that the coating of each individual workpiece is to be controlled separately. In particular, precisely one flow channel having a bath electrode is assigned to each workpiece, into which a partial electrolyte stream is introduced with the aid of the flow distributor, the partial electrolyte stream may be conducted through a throttle constriction of the flow channel after passing the bath electrode and subsequently striking the workpiece through the screen. Alternatively, it is conceivable that each workpiece is connected electrically conducting to precisely one single component electrode, which is especially assigned to each workpiece and is to be controlled individually. In the case of workpieces suitable for this purpose, it is conceivable that groups of workpieces are interconnected in such a way that, for example, in a matrix of 12×12 workpieces, for example, each 3×3 has the same potential or the same component electrode.

According to a further refinement, it is provided that a plurality of bath electrodes, a plurality of component electrodes, a plurality of additional electrodes, a plurality of flow channels, and/or the flow distributor is/are situated in a cassette, which is provided in particular in such a way that it is modularly replaceable. The plurality of bath electrodes, the plurality of component electrodes, the plurality of additional electrodes, the plurality of flow channels, and/or the flow distributor are therefore advantageously replaceable comparatively simply, for example, for repair and maintenance work and/or to adapt the corresponding components to the plurality of workpieces. Furthermore, a comparatively simple and cost-effective upgrade of the device known from the related art is thus possible, the cassette may be situated between the screen and the supply flow chamber. The cassette is in particular situated in the flow shaft or is alternatively part of the flow shaft.

According to a further refinement, it is provided that the cassette has at least one terminal element, which is provided for the individual electrical contacting of a plurality of bath electrodes and/or a plurality of additional electrodes. The terminal element particularly may include a multicore electrical plug contact, which functions for the electrical contacting of each individual bath electrode and/or additional electrode, so that each bath electrode and/or additional electrode is switchable separately and externally to impact the particular partial electrolyte stream in the direction of the at least one workpiece. In addition, it would be conceivable that each individual component electrode, bath electrode, and/or additional electrode may be electrically contacted with the aid of the multicore electrical plug contact.

A further object of the exemplary embodiments and/or exemplary methods of the present invention is a cassette for a device for simultaneous coating of a plurality of workpieces, the cassette having a plurality of flow channels, which are situated in a matrix, and at least one bath electrode being situated in each flow channel. The cassette is advantageously insertable in a simple way into an existing device for simultaneous coating or de-coating of a plurality of workpieces, for example, according to the related art, so that the quality of the coating in the device is significantly increased. It is therefore possible to upgrade and improve an already existing device with the aid of the cassette in a comparatively cost-effective way, the cassette may be inserted between the screen and the supply flow chamber, so that the electrolyte stream is settable separately in the direction of each individual workpiece. A matrix arrangement of the flow channels as defined in the exemplary embodiments and/or exemplary methods of the present invention includes in particular an arrangement of the flow channels adjacent to one another perpendicularly to the flow direction.

According to a refinement, it is provided that an additional electrode, in particular a virtual electrode, is further situated in each flow channel and/or the cassette has a flow distributor, so that the electric field is advantageously to be oriented between the bath electrode and the workpiece and/or the entire electrolyte stream is distributed uniformly in particular onto the plurality of flow channels.

A further object of the exemplary embodiments and/or exemplary methods of the present invention is a method for simultaneous coating of a plurality of workpieces using a device, the electrolyte stream in the direction of the at least one workpiece being influenced by corresponding control of the at least one bath electrode. An impact of the electrolyte stream at least in the direction of the at least one workpiece is therefore advantageously independent of the electrolyte streams in the direction of adjacent workpieces, so that the quality of the coating is increased and the rejection rate of incorrectly coated workpieces is reduced. This is achieved in that the electric field between the workpiece and the bath electrode is formed due to the electrical contact between the workpiece and the component electrode depending on the wiring of the bath electrode, so that the electrolyte stream in the direction of the workpiece may be impacted separately.

According to a refinement, it is provided that the electrolyte stream in the direction of the workpiece is further impacted by the at least one additional electrode. The electric field between the workpiece and the bath electrode is therefore advantageously guided directed onto the workpiece. This is achieved in particular using a virtual electrode in the form of a throttle constriction in the flow channel between the bath electrode and the workpiece.

According to a further refinement, it is provided that a distribution of the electrolyte stream to a plurality of flow channels is performed with the aid of the flow distributor, so that the entire electrolyte stream flowing through the flow shaft from the direction of the flow shaft is divided into a plurality of partial electrolyte streams, which are of equal size in particular, and which are each provided for coating precisely one individual workpiece, are each introduced for this purpose into a corresponding flow channel leading to the workpiece, and are modified accordingly with the aid of precisely one bath electrode in the flow channel.

A further object of the exemplary embodiments and/or exemplary methods of the present invention is a workpiece manufactured using a method according to the present invention. This workpiece may advantageously be manufactured comparatively cost-effectively and includes a comparatively high coating quality in comparison to the related art.

Exemplary embodiments of the present invention are shown in the drawings and explained in greater detail in the following description.

DETAILED DESCRIPTION

Figure 1:
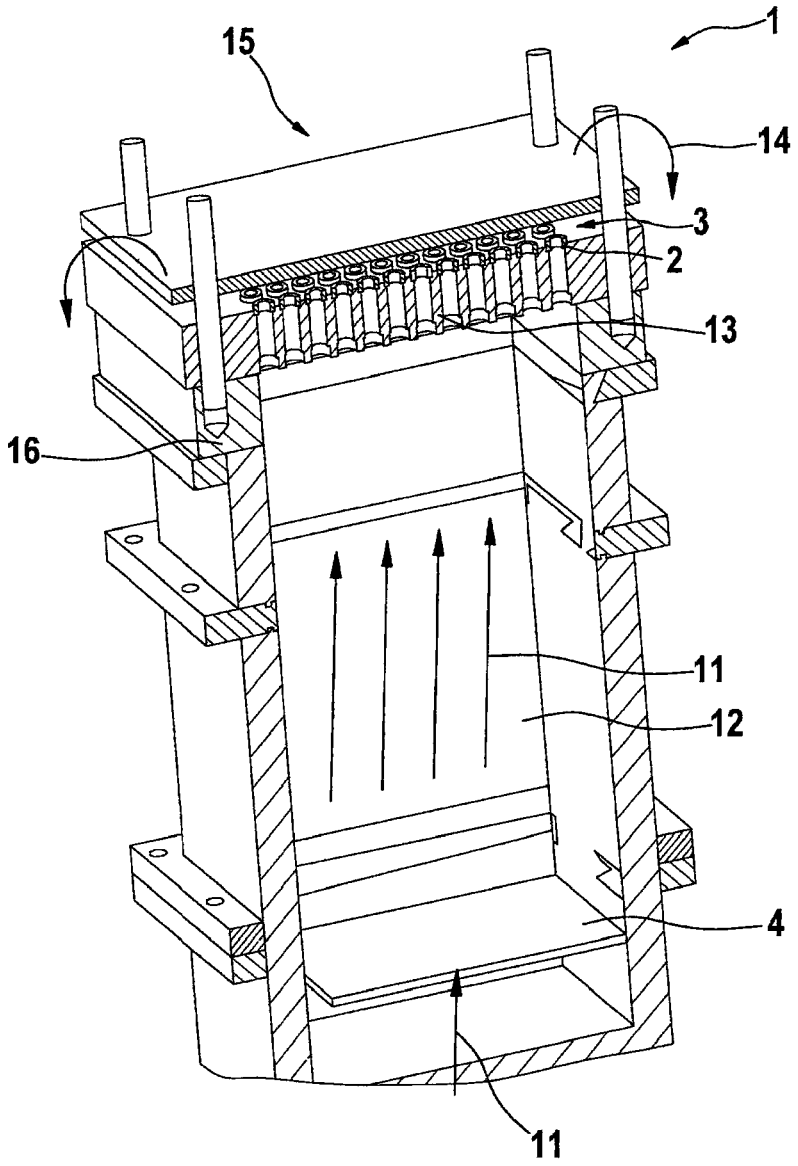
FIG. 1 shows a schematic perspective view of a device according to the related art.

Identical parts are always provided with identical reference numerals in the various figures and are therefore also typically only mentioned or noted once.

A schematic perspective view of a device 1 according to the related art is shown in FIG. 1, device 1 having a component electrode 3 in the form of a planar electrode, which is connected electrically conducting to a plurality of workpieces 2. Workpieces 2 are situated in a matrix arrangement. A bath electrode 4 in the form of a further planar electrode is situated on a side of device 1 diametrically opposite to component electrode 3. A flow shaft 12, also referred to as a supply flow chamber in the description, is situated between bath electrode 4 and component electrode 3. Due to an electric potential difference which is applied between bath electrode 4 and component electrode 3, a stream of electrolyte 11 flows from bath electrode 4 through flow shaft 12 in the direction of component electrode 3, whereby the plurality of workpieces 2 are coated simultaneously. Furthermore, a screen 13 is situated between flow shaft 12 and workpieces 2, which has a plurality of openings in the area of workpieces 2, so that electrolyte 11 is only applied to partial areas of the surface of workpieces 2, and the adjoining surface areas of workpieces 2 are covered by screen 13 in the direction of flow shaft 12. In the area of component electrode 3, device 1 includes an overflow 14 for electrolyte 11. Furthermore, device 1 has a replaceable workpiece holder cassette 15 in the area of component electrode 3 for contacting and/or receiving individual workpieces 2, which is further suitable for the simultaneous replacement of the plurality of workpieces 2 before and after the coating or de-coating process with respect to time and is provided for fastening in an intermediate screen 16.

Figure 2:
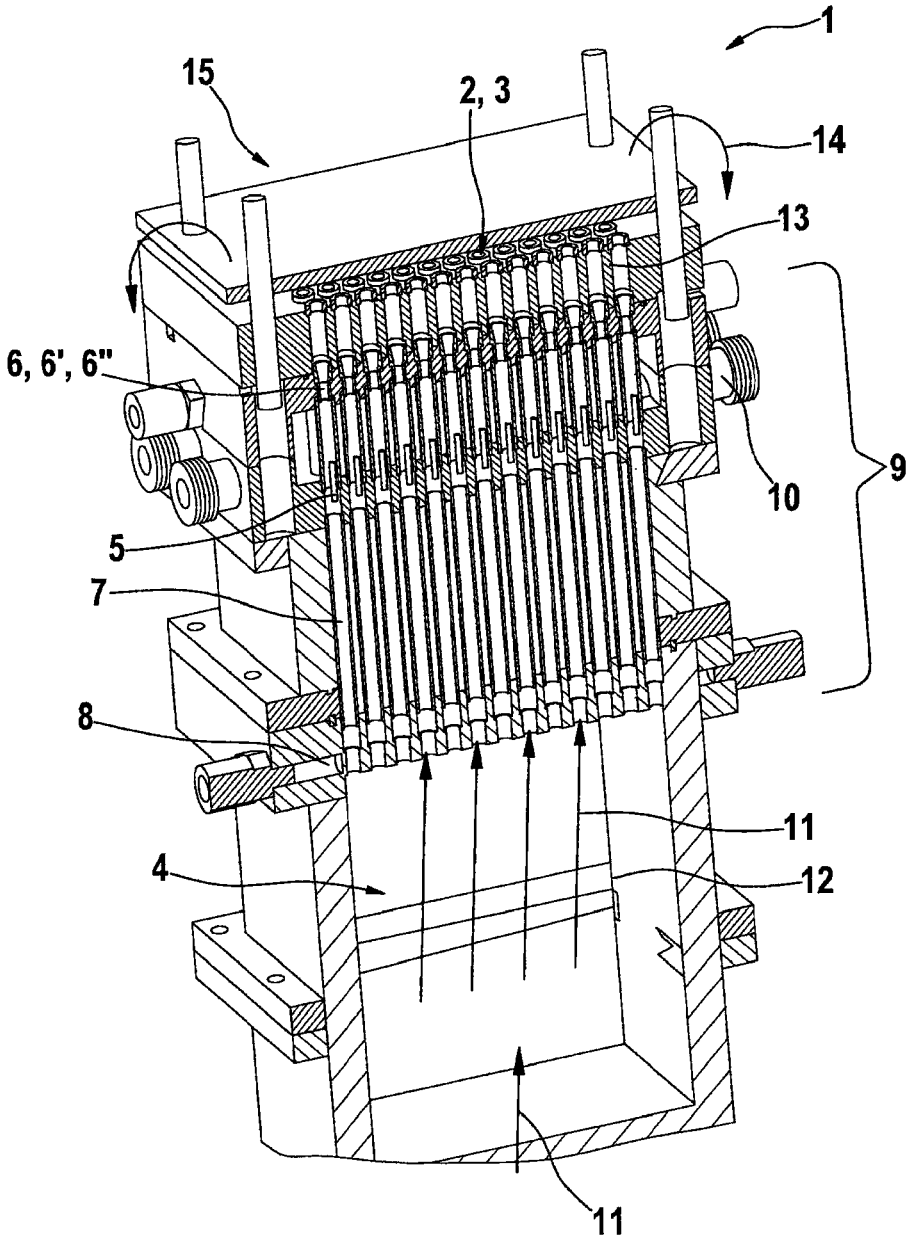
FIG. 2 shows a schematic perspective view of a device according to an exemplary specific embodiment of the present invention.

FIG. 2 shows a schematic perspective view of a device 1 according to an exemplary specific embodiment of the present invention, device 1 essentially being identical to device 1 illustrated in FIG. 1 and additionally having a cassette 9 according to an exemplary specific embodiment of the present invention. Cassette 9 is inserted instead of intermediate screen 16 below screen 13 in flow shaft 12 and includes a plurality of flow channels 7, which are situated in a matrix arrangement.

On a side facing away from the plurality of workpieces 2, cassette 9 has a flow distributor 8 (also referred to as a collector), which divides the entire electrolyte stream 11 flowing from the direction of flow shaft 12 in the direction of workpieces 2 onto the plurality of flow channels 7 in such a way that a plurality of partial electrolyte streams 11' of approximately equal size is produced. Partial electrolyte streams 11' are conducted by flow channels 7 directly onto workpieces 2, precisely one flow channel 7 being assigned to each workpiece 2. Precisely one bath electrode 5 is situated between workpieces 2 and flow distributor 8 in each flow channel 7, whereby planar bath electrode 4, which is still shown situated in flow shaft 8 in FIG. 1, is no longer necessary. The electric potential of these bath electrodes 5 is to be connected separately for each workpiece 2, so that an individual electric field forms in each flow channel 7 between workpiece 2, which is connected to component electrode 3, and bath electrode 5, which is capable of impacting the flow behavior of particular partial electrolyte stream 11'. In particular, for example, a poor electrical contact between component electrode 3 and workpiece 2 or a poor surface condition of workpiece 2 is therefore compensated for, so that in spite of simultaneous coating of the entire plurality of workpieces 2, individual adaptation and optimization of the coating on individual workpieces 2 is made possible and therefore a high coating quality is achieved with a comparatively large throughput of device 1.

Furthermore, each flow channel 7 optionally has an additional electrode 6, in particular a virtual electrode 6' in the form of a throttle constriction 6", which is situated in each case between workpiece 2 and bath electrode 5. This virtual electrode 6' is used for the purpose of bundling and directing the particular electric field, in particular flow channel 7, in the direction of workpiece 2 in each case. Cassette 9 further includes a terminal element 10, which is insulated from the electrolyte, in the form of a multicore terminal plug, which is used for the external electrical contacting of individual bath electrodes 5. Device 1 optionally includes an overflow 15 for electrolyte stream 11 in the area of component electrode 3. In this area, device 1 optionally includes a collector, in which the partial electrolyte streams are unified again and are guided in the direction of the supply flow of electrolyte 11. Furthermore, component electrode 3 alternatively includes a planar electrode, which is connected electrically conducting to all workpieces 2, so that all workpieces 2 are at the same electric potential, or a plurality of component electrodes 3, one workpiece 2 being connected in each case to a single component electrode 3, for example, so that various workpieces 2 may be at different electric potentials. The particular electric potentials of individual component electrodes 3 or workpieces 2 may be externally settable in this case. Device 1 also optionally includes an additional shared bath electrode 4 in the form of a planar electrode for all workpieces 2 together, which is situated in the area of the supply flow of electrolyte 11. In a specific embodiment, a cover of device 1 is used as a workpiece holder cassette 16, workpiece holder cassette 16 being provided for transporting workpieces 2 and, alternatively to the simultaneous replacement of all workpieces 2, automatic replacement of only individual workpieces 2 being provided.

For guiding the electrolyte, the device may include a semi-open system having a free overflow or a closed system in which the electrolyte is returned within flow shaft 12 up to a collector. Component electrodes 3 may include cathodes and bath electrodes 5 may include anodes. Individual workpieces 2 are each wired to an individual rectifier. The walls of flow shaft 12, flow distributor 8, and/or flow channels 7 may be made of an electrically nonconductive material or have an electrically nonconductive coating. In particular the supply stream and/or the overflow of the electrolyte are electrically insulated from one another.

Figure 3:
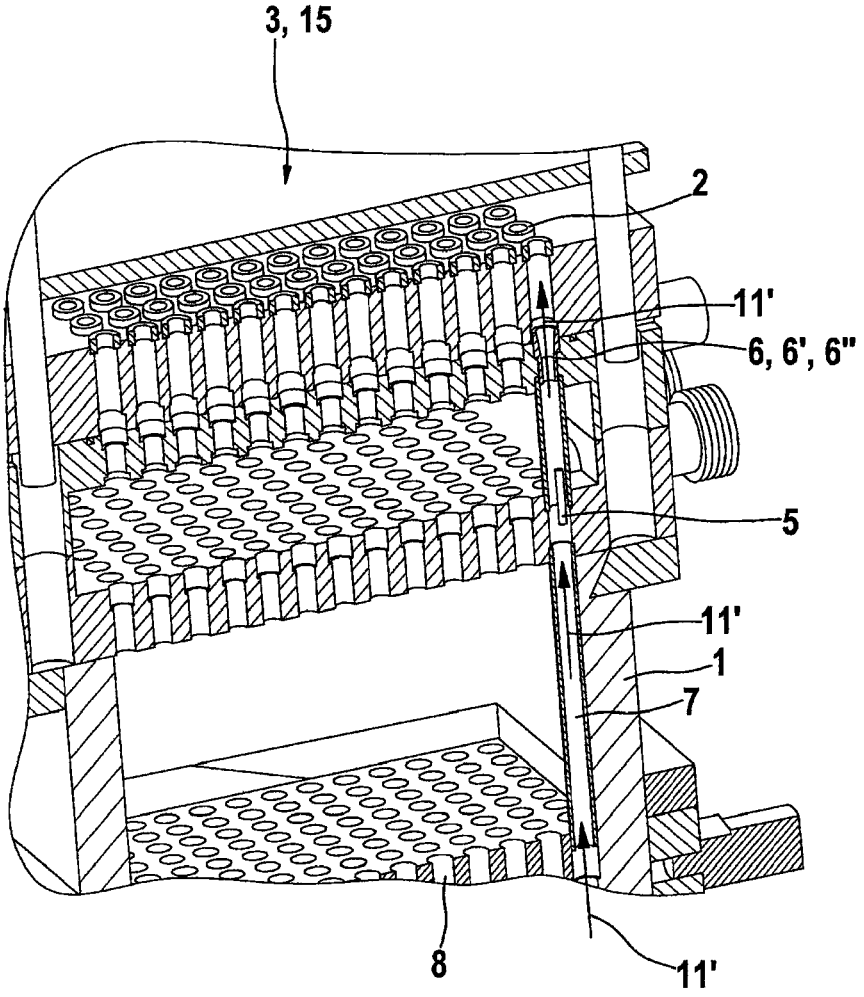
FIG. 3 shows a schematic perspective view of a detail of the device according to the exemplary specific embodiment of the present invention.

FIG. 3 shows a schematic perspective view of a detail of device 1 according to the exemplary specific embodiment of the present invention, the detail showing the plurality of workpieces 2, component electrodes 3, and screen 13, as well as a part of cassette 9. Cassette 9 is shown having flow distributor 8, the plurality of bath electrodes 5, and the plurality of throttle constriction points 6", while only one flow channel 7 for guiding a partial electrolyte stream 11' is illustrated for reasons of clarity.

Figure 4:
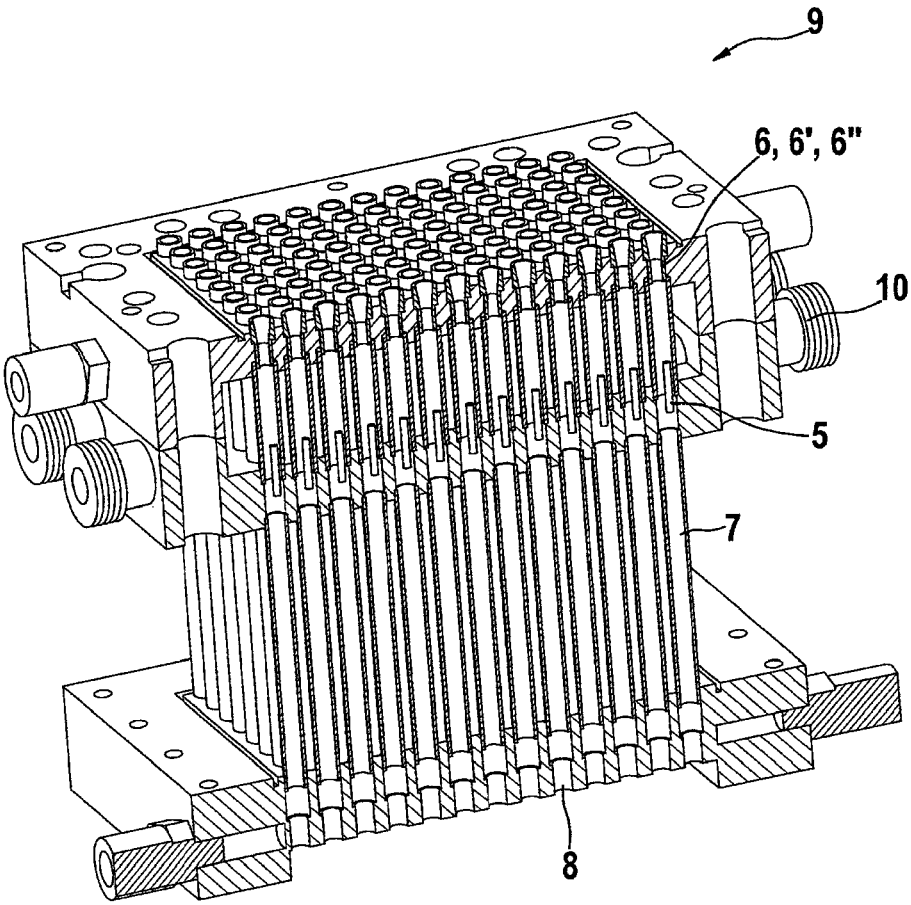
FIG. 4 shows a schematic perspective view of a cassette according to an exemplary specific embodiment of the present invention.

FIG. 4 shows a schematic perspective view of a cassette 9 according to an exemplary specific embodiment of the present invention, cassette 9 being identical to cassette 9 shown in FIGS. 2 and 3 and being designed as a replaceable module. Cassette 9 is therefore removable from device 1 for repair and maintenance work, for example. Furthermore, the modular design of cassette 9 allows, for example, an upgrade of device 1 illustrated in FIG. 1, the module being situated in device 1 in flow shaft 12 and instead of intermediate screen 16. Bath electrodes 5 are subsequently contacted by terminal elements 10.

What is claimed is:

1. A device for the simultaneous coating or de-coating of a plurality of workpieces, comprising:

at least one component electrode;

at least one bath electrode; and a shared flow shaft, through which an electrolyte flows, for situating the plurality of workpieces, each of the workpieces being connected electrically conducting to the at least one component electrode and being electrically insulated in relation to the at least one bath electrode;

wherein:

(a) a plurality of flow channels that each corresponds to, and is spaced apart from, a respective one of the plurality of workpieces and (b) a flow distributor for distributing the electrolyte to the plurality of flow channels are situated in the flow shaft, the at least one bath electrode being situated in one of the flow channels; and each of the flow channels directly conducts the electrolyte onto the respective workpiece to which the respective flow channel corresponds.

2. The device of claim 1, wherein at least one of a single component electrode and a bath electrode is assigned to multiple ones of the workpieces.

3. The device of claim 1, wherein an additional electrode, which includes a virtual electrode and a throttle, is situated between the at least one component electrode and the at least one bath electrode.

4. The device of claim 1, wherein at least one of one component electrode, one bath electrode, and one additional electrode is assigned in each case to precisely one of the workpieces.

5. The device of claim 1, wherein at least one of a plurality of bath electrodes, a plurality of component electrodes, a plurality of additional electrodes, a plurality of flow channels, and the flow distributor is situated in a cassette, which is modularly replaceable.

6. A cassette for a device for simultaneous coating or de-coating of a plurality of workpieces, comprising:

a device for the simultaneous coating or de-coating of a plurality of workpieces, including:

at least one component electrode;

a plurality of at least one bath electrodes; and a shared flow shaft, through which an electrolyte flows, for situating the plurality of workpieces, each of the workpieces being connected electrically conducting to the at least one component electrode and being electrically insulated in relation to the at least one bath electrode;

wherein:

(a) a plurality of flow channels that are situated in a matrix and that each corresponds to, and is spaced apart from, a respective one of the plurality of workpieces and (b) a flow distributor for distributing the electrolyte to the plurality of flow channels are situated in the flow shaft, the at least one bath electrode being situated in one each of the flow channels having situated therein at least one respective one of the bath electrodes; and wherein the cassette includes a plurality each of the flow channels, which are situated in a matrix, and at least one bath electrode being situated in each of directly conducts the electrolyte onto the respective workpiece to which the respective flow channels channel corresponds.

7. The cassette of claim 6, wherein at least one of the following is satisfied: (i) an additional electrode, which is a virtual electrode, is further situated in each of the flow channels, and (ii) the cassette has at least one of a flow distributor and at least one terminal element, which is provided for the individual electrical contacting of at least one of a plurality of bath electrodes and a plurality of additional electrodes.

8. A method for simultaneous coating or de-coating of a plurality of workpieces using a device, as recited in one of the preceding claims, comprising: impacting a stream of electrolyte in a direction of the at least one of the workpieces is by a corresponding control of at least one bath electrode; the device for the simultaneous coating or de-coating of the plurality of workpieces, including: (I) at least one component electrode, (II) at least one bath electrode, and (III) a shared flow shaft, through which an electrolyte flows, for situating the plurality of workpieces, each of the workpieces being connected electrically conducting to the at least one component electrode and being electrically insulated in relation to the at least one bath electrode, the method comprising:

impacting a stream of the electrolyte in a direction of the at least one of the workpieces by a corresponding control of the at least one bath electrode;

wherein:

(a) a plurality of flow channels that each corresponds to, and is spaced apart from, a respective one of the plurality of workpieces and (b) a flow distributor for distributing the electrolyte to the plurality of flow channels are situated in the flow shaft, the at least one bath electrode being situated in one of the flow channels; and each of the flow channels directly conducts the electrolyte onto the respective workpiece to which the respective flow channel corresponds.

9. The method of claim 8, wherein at least one of the stream of the electrolyte in the direction of the workpiece is further impacted by the at least one additional electrode and an essentially uniform distribution of the stream of the electrolyte to the plurality of flow channels is performed with the aid of the flow distributor.

* * * * *